US011149968B2

(12) United States Patent
Koike et al.

(10) Patent No.: US 11,149,968 B2
(45) Date of Patent: Oct. 19, 2021

(54) HEAT SOURCE UNIT

(71) Applicant: DAIKIN INDUSTRIES, LTD., Osaka (JP)

(72) Inventors: Fumiaki Koike, Osaka (JP); Shigeki Kamitani, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 13 days.

(21) Appl. No.: 16/090,798

(22) PCT Filed: Feb. 28, 2017

(86) PCT No.: PCT/JP2017/007861
§ 371 (c)(1),
(2) Date: Oct. 2, 2018

(87) PCT Pub. No.: WO2017/175520
PCT Pub. Date: Oct. 12, 2017

(65) Prior Publication Data

US 2019/0338964 A1 Nov. 7, 2019

(30) Foreign Application Priority Data

Apr. 6, 2016 (JP) ..... JP2016-076392

(51) Int. Cl.
*F24F 1/46* (2011.01)
*F24F 1/12* (2011.01)
*F24F 1/40* (2011.01)

(52) U.S. Cl.
CPC ..... *F24F 1/46* (2013.01); *F24F 1/12* (2013.01); *F24F 1/40* (2013.01)

(58) Field of Classification Search
CPC ..... F24F 1/56; F24F 1/40; H02K 5/24; F25B 2500/13
See application file for complete search history.

(56) References Cited

U.S. PATENT DOCUMENTS 2,315,398 A * 3/1943 Clark ..... F16F 15/067 248/561
4,598,503 A * 7/1986 Berger ..... E04B 1/98 248/544

(Continued)

FOREIGN PATENT DOCUMENTS

CN 204438381 U * 7/2015
EP 2787292 A1 10/2014

(Continued)

OTHER PUBLICATIONS

International Preliminary Report on Patentability for corresponding International Application No. PCT/JP2017/007861, dated Oct. 18, 2018 (9 pages).

(Continued)

*Primary Examiner* — Frantz F Jules
*Assistant Examiner* — Martha Tadesse
(74) *Attorney, Agent, or Firm* — Osha Bergman Watanabe & Burton LLP

(57) ABSTRACT

A heat source unit including: mounting feet; a bottom frame disposed on the mounting feet; vibration-proofing members that are disposed between the bottom frame and the mounting feet and space the bottom frame apart from the mounting feet; and a plurality of struts that extend upward from the mounting feet. All of the struts are anchored to the mounting feet without being anchored to the bottom frame.

3 Claims, 4 Drawing Sheets

(56) References Cited

U.S. PATENT DOCUMENTS

| | | | | |
|---|---|---|---|---|
| 7,458,556 | B1 | 12/2008 | Manucy | |
| 7,707,798 | B1 * | 5/2010 | Cullinan | F24F 1/40 52/780 |
| 9,228,692 | B2 * | 1/2016 | Wilson, Jr. | F16M 5/00 |
| 9,933,183 | B1 * | 4/2018 | Den Adel | F24F 13/32 |
| 10,337,775 | B2 * | 7/2019 | Misaljevic | F24F 13/32 |
| 2009/0114376 | A1 * | 5/2009 | Ishida | F24F 1/50 165/104.31 |
| 2012/0193505 | A1 * | 8/2012 | Baron | F16F 15/06 248/636 |
| 2015/0000321 | A1 * | 1/2015 | Kagawa | F24F 1/50 62/291 |
| 2015/0060029 | A1 * | 3/2015 | Ono | F24F 1/40 165/162 |

FOREIGN PATENT DOCUMENTS

| | | | | |
|---|---|---|---|---|
| JP | H03-03635 | U | | 1/1991 |
| JP | H04-85029 | U | | 7/1992 |
| JP | 09222245 | A | * | 8/1997 |
| JP | 09303825 | A | * | 11/1997 |
| JP | H11-264588 | A | | 9/1999 |
| JP | 2007-147250 | A | | 6/2007 |
| JP | 2007147250 | A | * | 6/2007 |
| JP | 2009-103354 | A | | 5/2009 |
| JP | 2011-158137 | A | | 8/2011 |
| JP | 2016-38175 | A | | 3/2016 |
| JP | 201618344 | | * | 3/2016 |

OTHER PUBLICATIONS

Extended European Search Report issued in European Application No. 17778899.9; dated Mar. 20, 2019 (8 pages).

International Search Report issued in corresponding International Application No. PCT/JP2017/007861 dated May 30,2017, with translation (5 pages).

Written Opinion of the International Searching Authority issued in corresponding International Application No. PCT/JP2017/007861 dated May 30, 2017 (5 pages).

Office Action Issued in corresponding Japanese Patent Application No. 2016-076392 dated May 22, 2017, with translation (9 pages).

* cited by examiner

HEAT SOURCE UNIT

TECHNICAL FIELD

The present invention relates to a heat source unit, and particularly a heat source unit having a structure where a bottom frame is provided on mounting feet.

BACKGROUND

Conventionally, there is an air conditioning system configured as a result of a heat source unit and a utilization unit being connected by pipes. Examples of the heat source unit configuring this kind of air conditioning system include a heat source unit having a structure where a bottom frame is provided on mounting feet, such as described in patent document 1 (JP-A No. 2011-158137). Devices such as a compressor are provided on the bottom frame, and these devices are connected by refrigerant pipes.

PATENT LITERATURE

Patent Document 1: JP-A No. 2011-158137

In the conventional heat source unit described above, during transport, transport vibrations travel through the mounting feet to the bottom frame and also propagate through the devices provided on the bottom frame to the refrigerant pipes. At this time, if the transport vibrations are intense, there is the concern that the refrigerant pipes will sustain damage. Furthermore, during operation, operational vibrations of the compressor travel through the bottom frame to the mounting feet and also travel from the mounting feet to the installation surface on which the heat source unit is provided. At this time, in a case where the installation surface is on the roof of a building or adjacent to a wall surface of a building, there is the concern that the operational vibrations of the heat source unit will propagate to the building.

SUMMARY

One or more embodiments of the present invention reduce, in a heat source unit having a structure where a bottom frame is provided on mounting feet, the propagation of transport vibrations to the bottom frame and the propagation of operational vibrations to the mounting feet.

A heat source unit according to one or more embodiments of the present invention includes: mounting feet; a bottom frame provided on the mounting feet; and vibration-proofing members that are provided between the bottom frame and the mounting feet and space the bottom frame and the mounting feet apart from each other.

Here, during transport, transport vibrations can be reduced from propagating through the mounting feet to the bottom frame, and during operation, operational vibrations can be reduced from propagating through the bottom frame to the mounting feet; because of this, damage to refrigerant pipes caused by transport vibrations, and the propagation of operational vibrations to buildings, can be prevented.

A heat source unit according to one or more embodiments of the present invention is the heat source unit pertaining to the first aspect, further including struts that extend upward from the mounting feet. The struts are anchored to the mounting feet but are not anchored to the bottom frame.

Here, operational vibrations can be reduced from propagating to the struts; because of this, the vibration performance and the noise performance of the heat source unit can be improved.

A heat source unit according to one or more embodiments of the present invention is the heat source unit pertaining to the first or second aspect, wherein the bottom frame is a plate-like member. The mounting feet have support portions that support end portions of the bottom frame from below and wall portions that are positioned on outer sides of the end portions of the bottom frame and extend upward from the support portions. The vibration-proofing members are provided between the end portions of the bottom frame and the support portions.

Here, the wall portions can ensure that the vibration-proofing members cannot be seen from the outer side of the bottom frame; because of this, the visual aesthetic of the heat source unit can be improved.

A heat source unit according to one or more embodiments of the present invention is the heat source unit pertaining to the first to third aspects, wherein a compressor and refrigerant pipes are provided on the bottom frame.

Here, the compressor, which is the source of operational vibrations, and the refrigerant pipes, which are easily affected by transport vibrations, are provided on the bottom frame.

However, here, as described above, during transport, transport vibrations can be reduced from propagating to the refrigerant pipes, and during operation, operational vibrations of the compressor can be reduced from propagating to the mounting feet.

DETAILED DESCRIPTION

Embodiments of a heat source unit and various modifications will be described below on the basis of the drawings. It will be noted that the specific configurations of the heat source unit according to one or more embodiments of the present invention are not limited to those described below including the modifications, and can be changed in a range that does not depart from the technical scope of this disclosure.

(1) Configuration of Air Conditioning System

Figure 1:
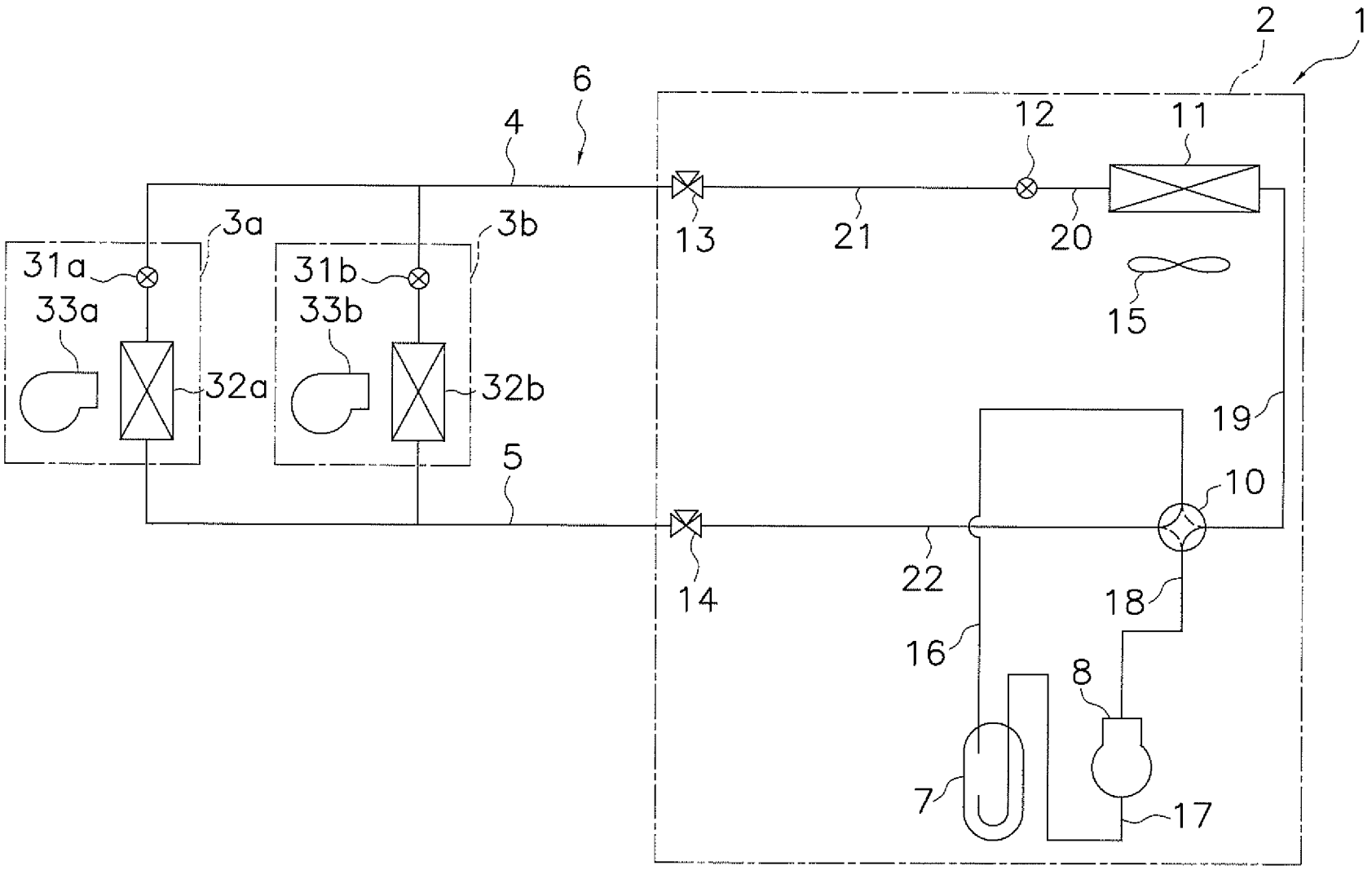
FIG. 1 is a general configuration diagram of an air conditioning system in which a heat source unit according to one or more embodiments of the present invention is employed.

FIG. 1 is a general configuration diagram of an air conditioning system 1 in which a heat source unit 2 according to one or more embodiments of the present invention is employed.

The air conditioning system 1 is a system that performs cooling and heating of rooms in a building, for example, by performing a vapor compression refrigeration cycle. The air conditioning system 1 is configured as a result of mainly the heat source unit 2 and utilization units 3*a* and 3*b* being connected. Here, the heat source unit 2 and the utilization units 3*a* and 3*b* are connected via a liquid refrigerant communication pipe 4 and a gas refrigerant communication pipe 5. That is, a vapor compression refrigerant circuit 6 of the air conditioning system 1 is configured as a result of the heat source unit 2 and the utilization units 3*a* and 3*b* being connected via the refrigerant communication pipes 4 and 5.

The heat source unit 2 is installed outdoors (e.g., on the roof of the building or adjacent to a wall surface of the building) and configures part of the refrigerant circuit 6. The heat source unit 2 mainly has an accumulator 7, a compressor 8, a four-port switching valve 10, a heat source-side heat exchanger 11, a heat source-side expansion valve 12, a liquid-side stop valve 13, a gas-side stop valve 14, and a heat source-side fan 15. The devices and valves are connected to each other by refrigerant pipes 16 to 22.

The utilization units 3*a* and 3*b* are installed in rooms (e.g., living rooms or spaces on the reverse sides of ceilings) and configure part of the refrigerant circuit 6. The utilization unit 3*a* mainly has a utilization-side expansion valve 31*a*, a utilization-side heat exchanger 32*a*, and a utilization-side fan 33*a*. The utilization unit 3*b* mainly has a utilization-side expansion valve 31*b*, a utilization-side heat exchanger 32*b*, and a utilization-side fan 33*b*.

The refrigerant communication pipes 4 and 5 are refrigerant pipes constructed on site when installing the air conditioning system 1 in an installation location such as a building. One end of the liquid refrigerant communication pipe 4 is connected to the liquid-side stop valve 13 of the heat source unit 2, and the other end of the liquid refrigerant communication pipe 4 is connected to liquid-side ends of the utilization-side expansion valves 31*a* and 31*b* of the utilization units 3*a* and 3*b*. One end of the gas refrigerant communication pipe 5 is connected to the gas-side stop valve 14 of the heat source unit 2, and the other end of the gas refrigerant communication pipe 5 is connected to gas-side ends of the utilization-side heat exchangers 32*a* and 32*b* of the utilization units 3*a* and 3*b*.

(2) Configuration of Heat Source Unit

Figure 2:
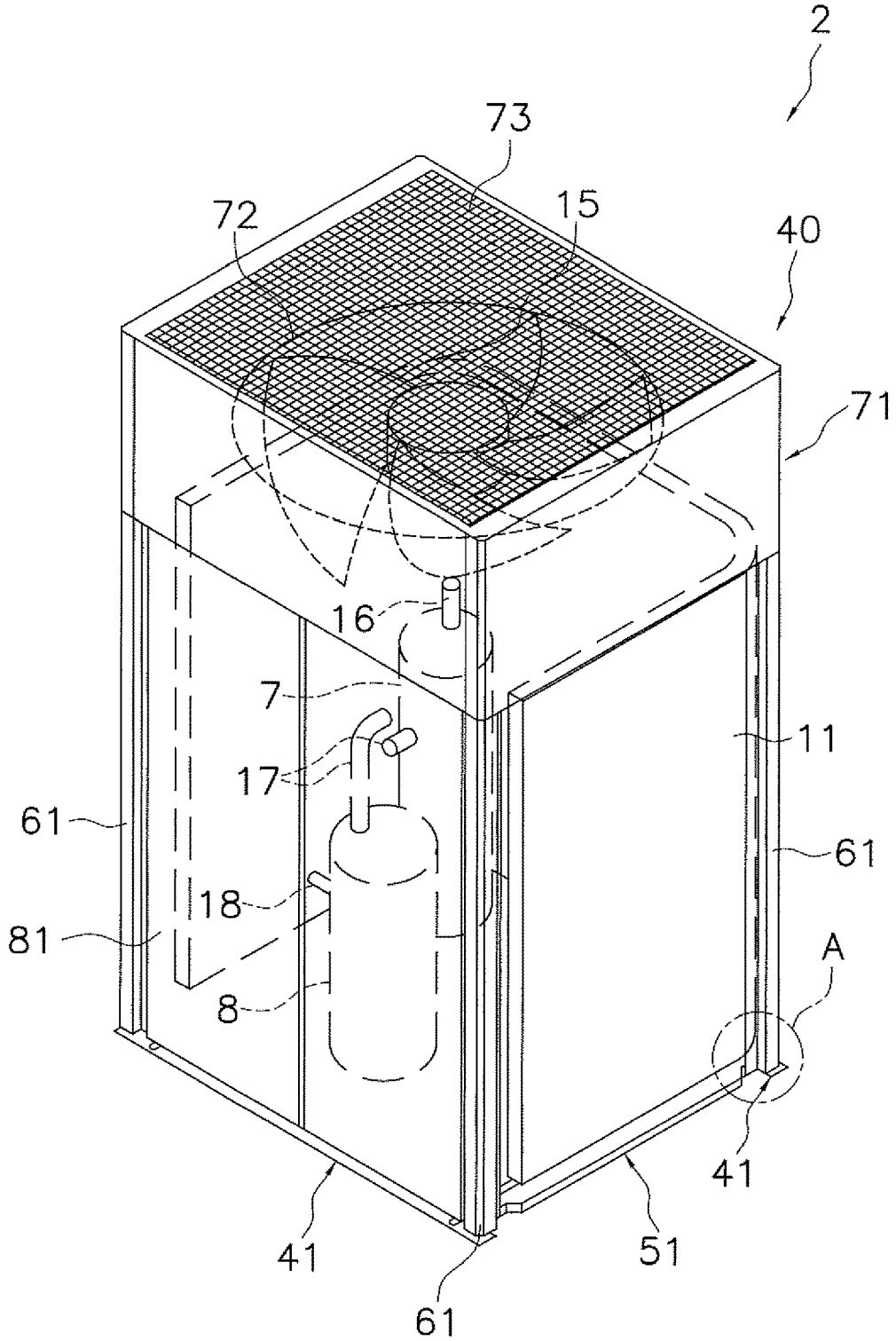
FIG. 2 is an external perspective view of the heat source unit according to one or more embodiments.
Figure 3:
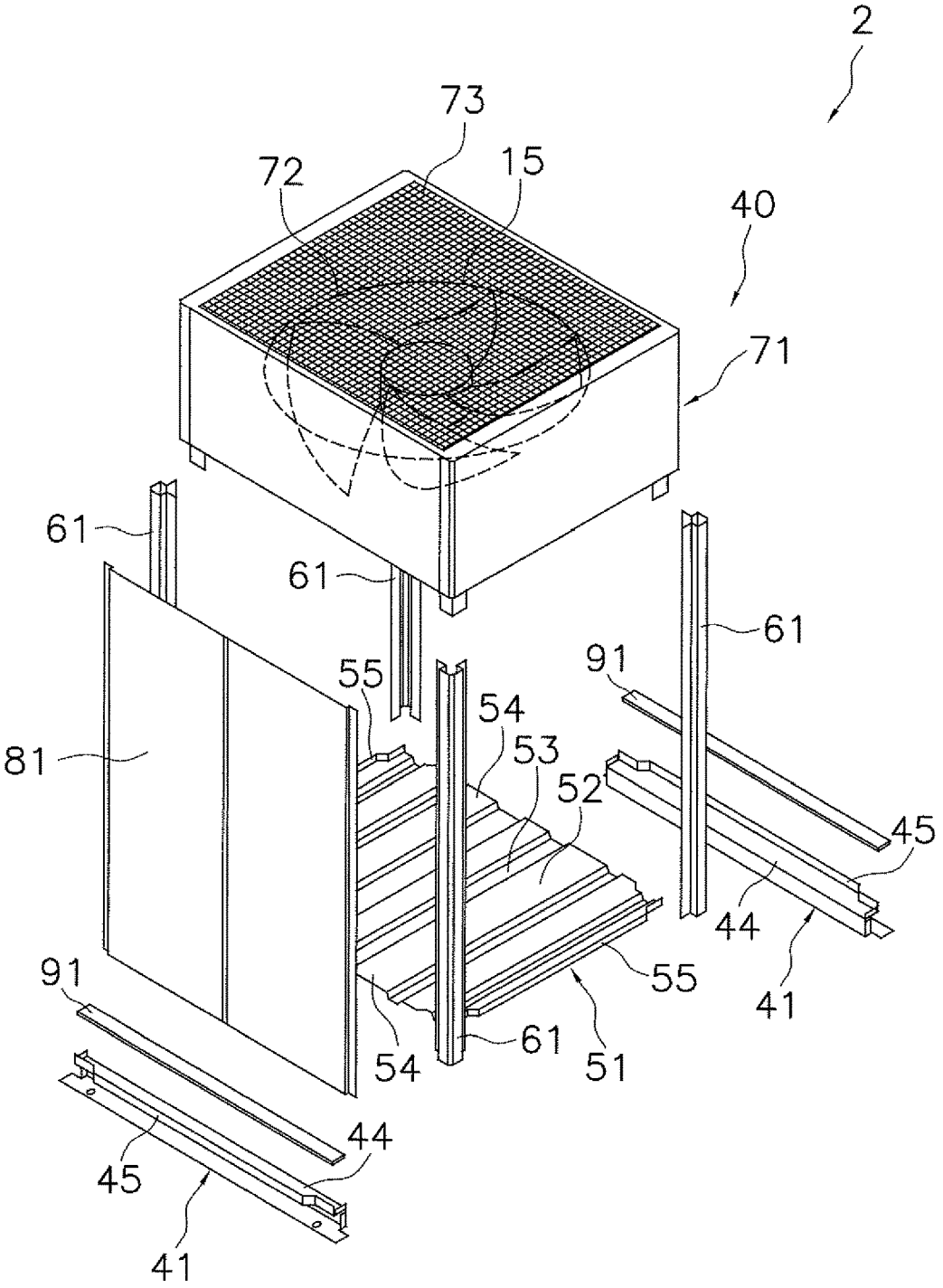
FIG. 3 is an exploded perspective view of the heat source unit (excluding refrigerant circuit constituent parts) according to one or more embodiments.
Figure 4:
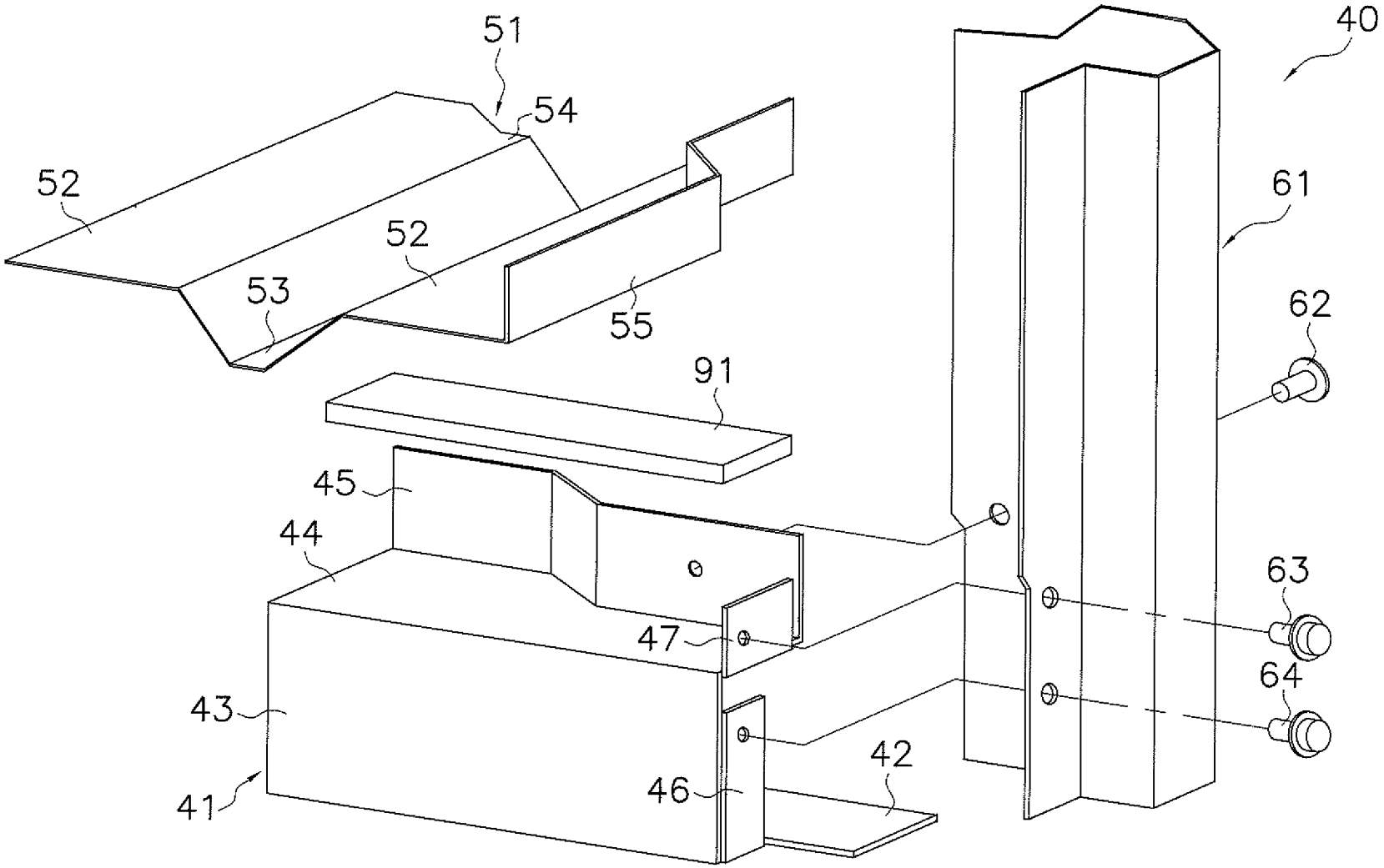
FIG. 4 is a perspective view (exemplifying part A of FIG. 2) showing an anchoring relationship between a bottom frame, a vibration-proofing member, a mounting foot, and a strut according to one or more embodiments.

FIG. 2 is an external perspective view of the heat source unit 2. FIG. 3 is an exploded perspective view of the heat source unit 2 (excluding refrigerant circuit constituent parts). FIG. 4 is a perspective view showing an anchoring relationship between a bottom frame 51, a vibration-proofing member 91, a mounting foot 41, and a strut 61.

<Overall Structure>

The heat source unit 2 has what is called an upward-blowing structure that takes air into a casing 40 from below and blows the air out to the outside of the casing 40 from above. The heat source unit 2 mainly has the casing 40 substantially in the shape of a rectangular parallelepiped box, the heat source-side fan 15, and refrigerant circuit constituent parts that configure part of the refrigerant circuit 6, and include the devices 7, 8, and 11 such as the compressor and the heat source-side heat exchanger, the valves 10 and 12 to 14 such as the four-port switching valve and the heat source-side expansion valve, and the refrigerant pipes 16 to 22. It will be noted that, unless otherwise specified, the directions of "upper," "lower," "left," "right," "front," "rear," "front surface," and "back surface" will mean directions in a case where the heat source unit 2 shown in FIG. 2 is seen from the front (diagonally forward and to the left in the drawing).

The casing 40 mainly has a bottom frame 51 that bridges a pair of mounting feet 41 extending in the right and left direction, struts 61 that extend in the vertical direction from corner portions of the bottom frame 51, a fan module 71 that is attached to the upper ends of the struts 61, and a front surface panel 81.

The bottom frame 51 forms a bottom surface of the casing 40, and the heat source-side heat exchanger 11 is provided on the bottom frame 51. Here, the heat source-side heat exchanger 11 is a heat exchanger that is substantially U-shaped as seen in a plan view and faces the back surface and both right and left side surfaces of the casing 40, and substantially forms the back surface and both right and left side surfaces of the casing 40.

The fan module 71 is provided on the upper side of the heat source-side heat exchanger 11 and forms a top surface of the casing 40 and sections of the front surface, the back surface, and both right and left side surfaces of the casing 40 on the upper side of the struts 61. Here, the fan module 71 is a composite body where the heat source-side fan 15 and a bell mouth 72 are housed in a substantially rectangular parallelepiped-shaped box whose upper surface and lower surface are open, and an air outlet grille 73 is provided in the opening in the upper surface.

The front surface panel 81 bridges the struts 61 on the front surface side and forms a front surface of the casing 40.

Also housed inside the casing 40 are refrigerant circuit constituent parts other than the heat source-side fan 15 and the heat source-side heat exchanger 11 (FIG. 2 shows the accumulator 7, the compressor 8, and the refrigerant pipes 16 to 18). Here, the compressor 8 is a device that compresses refrigerant and is provided on the bottom frame 51. Furthermore, the accumulator 7 is a refrigerant vessel that temporarily accumulates the refrigerant before the refrigerant is sucked into the compressor 8, and the accumulator 7 is provided on the bottom frame 51.

<Detailed Structure (Including Structure for Reducing Transport Vibrations and Operational Vibrations)>

The bottom frame 51 is a corrugated plate-like member in which ridge portions 52 and furrow portions 53 extending across the front and rear direction of the casing 40 are formed. The bottom frame 51 bridges the mounting feet 41. Supported end portions 54, which are end portions on the sides (here, in the front and rear direction) where the ridge portions 52 and the furrow portions 53 of the bottom frame 51 can be seen, are supported by the mounting feet 41. Outer wall portions 55, which extend upward beyond the ridge portions 52 and the furrow portions 53, are formed on end portions on the sides (here, in the right and left direction) orthogonal to the supported end portions 54 of the bottom frame 51. Additionally, in contrast to the right and left direction end portions of the bottom frame 51, outer wall portions are not formed on the supported end portions 54, and so the shape of the bottom frame 51 is simplified.

The mounting feet 41 are members that are substantially C-shaped as seen in a side view and extend in the right and left direction of the casing 40. The mounting feet 41 each mainly have an anchored portion 42 that becomes anchored to an installation surface, a vertical portion 43 that extends upward from an end portion of the anchored portion 42 on one side in the front and rear direction, and a support portion 44 that extends horizontally from the upper end portion of the vertical portion 43 toward the other side in the front and rear direction. The support portions 44 support the supported end portions 54 from below. Furthermore, the mounting feet 41 each have a wall portion 45 that extends upward from the end portion of the support portion 44 on the other side in the front and rear direction. The wall portions 45 are positioned on the outer sides of the supported end portions 54. That is, in the case of the mounting foot 41 disposed on the front surface side of the casing 40, the wall portion 45 is positioned on the front side of the supported end portion 54, and in the case of the mounting foot 41 disposed on the back surface side of the casing 40, the wall portion 45 is positioned on the back surface side of the supported end portion 54. Additionally, the wall portions 45 of the mounting feet 41 function as outer wall portions of the front and rear direction end portions of the bottom frame 51. That is, here, the wall portions 45 of the mounting feet 41 have the same function as the outer wall portions 55 of the right and left direction end portions of the bottom frame 51, while simplifying the shape of the bottom frame 51.

If the supported end portions 54 are provided directly on the support portions 44 of the mounting feet 41, there is concern with respect to the following kinds of vibrations. First, during transport, transport vibrations travel through the mounting feet 41 to the bottom frame 51 and also propagate through devices (e.g., the accumulator 7 and the compressor 8) provided on the bottom frame 51 to the refrigerant pipes 16 to 22. At this time, if the transport vibrations are intense, there is the concern that the refrigerant pipes 16 to 22, which are easily affected by transport vibrations, will sustain damage. Furthermore, during operation, operational vibrations of the compressor 8, which is the source of operational vibrations, travel through the bottom frame 51 to the mounting feet 41 and also travel from the mounting feet 41 to the installation surface on which the heat source unit 2 is provided. At this time, in a case where the installation surface is the roof of a building or in a case where it is adjacent to a wall surface of a building, there is the concern that the operational vibrations of the heat source unit 2 will propagate to the building.

Therefore, here, vibration-proofing members 91 that space the bottom frame 51 and the mounting feet 41 apart from each other are provided between the bottom frame 51 and the mounting feet 41. Specifically, the vibration-proofing members 91 are provided between the supported end portions 54 and the support portions 44. Here, the vibration-proofing members 91 are, for example, rubber sheets that are long and narrow in the right and left direction. That is, the mounting feet 41 support the bottom frame 51 in a state in which the furrow portions 53 of the supported end portions 54 are in contact with the support portions 44 via the vibration-proofing members 91.

Additionally, by employing this structure, in the heat source unit 2, during transport, transport vibrations can be reduced from propagating through the mounting feet 41 to the bottom frame 51, and during operation, operational vibrations can be reduced from propagating through the bottom frame 51 to the mounting feet 41. Because of this, damage to the refrigerant pipes 16 to 22 caused by transport vibrations, and the propagation of operational vibrations to buildings can be prevented. Furthermore, the number of support members for the refrigerant pipes 16 to 22 that had heretofore been necessary as a measure to counter transport vibrations can be reduced. Moreover, the vibration-proofing member between the mounting feet 41 and the installation surface that had heretofore been necessary as a measure to counter operational vibrations can be eliminated.

Moreover, here, as described above, the mounting feet 41 have the wall portions 45. For this reason, here, the wall portions 45 can ensure that the vibration-proofing members 91 cannot be seen from the outer side of the bottom frame 51. That is, the vibration-proofing member 91 disposed on the front surface side of the casing 40 cannot be seen because of the wall portion 45 of the mounting foot 41 disposed on the front surface side of the casing 40, and the vibration-proofing member 91 disposed on the back surface side of the casing 40 cannot be seen because of the wall portion 45 of the mounting foot 41 disposed on the back surface side of the casing 40. Because of this, the visual aesthetic of the heat source unit 2 is improved.

Furthermore, here, the heat source unit 2 employs a structure where the struts 61 that extend upward from the mounting feet 41 are anchored to the mounting feet 41 but are not anchored to the bottom frame 51. Specifically, the mounting feet 41 each have first anchor portions 46, which extend in the front and rear direction from the right and left direction end portions of the vertical portion 43, and second anchor portions 47, which extend upward from the right and left direction end portions of the support portion 44. Additionally, screw holes are formed in the lower end portions of the struts 61, the right and left direction end portions of the wall portions 54 of the mounting feet 41, and the first anchor portions 46 and the second anchor portions 47 of the mounting feet 41, and the struts 61 are anchored to the mounting feet 41 by screwing screws 62 to 64 into them. Additionally, as mentioned above, the struts 61 are not anchored to the bottom frame 51. Furthermore, because the struts 61 are anchored to the right and left direction end portions of the mounting feet 41, the seams between the right and left direction end portions of the mounting feet 41 and the corner portions of the bottom frame 51 cannot be seen by the struts 61 even when the casing 40 is viewed from the right and left directions. It will be noted that the specific positions at which, and the specific method by which, the struts 61 are anchored to the mounting feet 41 are not limited to what is described above.

Additionally, because this structure is employed, in the heat source unit 2, the operational vibrations of the compressor 21 can be reduced from propagating to the struts 61. Furthermore, the propagation of operational vibrations to the heat source-side fan 15 supported by the struts 61 (here, the fan module 71 attached to the upper ends of the struts 61) can also be reduced. Because of this, the vibration performance and the noise performance of the heat source unit 2 can be improved.

(3) Example Modifications

<A>

In one or more embodiments, the heat source unit 2 employs a structure where the fan module 71 including the heat source-side fan 15 and the bell mouth 72 is attached to the upper ends of the struts 61, but the heat source unit 2 is not limited to this. For example, the heat source unit 2 may also have a structure where the struts 61 are extended upward beyond the heat source-side heat exchanger 11 and where a support member that supports the heat source-side fan 15 and the bell mouth 72 from the struts 61 is provided.

<B>

In one or more embodiments, the ridge portions 52 and the furrow portions 53 of the bottom frame 51 were formed in such a way as to extend across the front and rear direction of the casing 40, but the ridge portions 52 and the furrow portions 53 are not limited to this and, as in patent document 1, may also be formed so as to extend across the right and left direction of the casing 40. Furthermore, here, the bottom frame 51 comprises only one member, but the bottom frame 51 may also be divided into two members as in patent document 1. Moreover, the bottom frame 51 may also be a plate-like member in which the ridge portions 52 and the furrow portions 53 that extend across the front and rear direction or the right and left direction of the casing 40 are not formed.

One or more embodiments of the present invention are widely applicable to a heat source unit having a structure where a bottom frame is provided on mounting feet.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

REFERENCE SIGNS LIST

2 Heat Source Unit
8 Compressor
16 to 22 Refrigerant Pipes
41 Mounting Feet
44 Support Portions
45 Wall Portions
51 Bottom Frame
54 Supported End Portions (End Portions of Bottom Frame)
61 Struts
91 Vibration-proofing Members

The invention claimed is:

1. A heat source unit comprising: a casing comprising a bottom frame; a pair of mounting feet; the bottom frame that is disposed on and bridges the pair of the mounting feet; rubber vibration-proofing sheets that are disposed between the bottom frame and the mounting feet and space the bottom frame apart from the mounting feet; and a plurality of struts that extend upward from the mounting feet, wherein the mounting feet have wall portions that extend upward higher than at least one edge of the bottom frame, and all of the struts are anchored to the mounting feet without being anchored to the bottom frame.

2. The heat source unit according to claim 1, wherein
the bottom frame is a plate-like member,
the mounting feet comprise support portions that support end portions of the bottom frame from below,
the wall portions are disposed on outer sides of the end portions of the bottom frame and extend upward from the support portions, and
the rubber vibration-proofing sheets are disposed between the end portions of the bottom frame and the support portions.

3. The heat source unit according to claim 1, wherein a compressor and refrigerant pipes are disposed on the bottom frame.

* * * * *